US006857413B2

(12) United States Patent
Yamamoto

(10) Patent No.: US 6,857,413 B2
(45) Date of Patent: Feb. 22, 2005

(54) POWER WORKING MACHINE WITH INTERNAL COMBUSTION ENGINE HAVING SPARK PLUG

(75) Inventor: Takayuki Yamamoto, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/323,919

(22) Filed: Dec. 20, 2002

(65) Prior Publication Data

US 2003/0121493 A1 Jul. 3, 2003

(30) Foreign Application Priority Data

Dec. 28, 2001 (JP) ..... 2001-399189

(51) Int. Cl.[7] ..... F02B 63/00
(52) U.S. Cl. ..... 123/198 E
(58) Field of Search ..... 123/198 E, 196 R, 123/196 CE, 198 D, 198 DC

(56) References Cited

U.S. PATENT DOCUMENTS 2,012,699 A * 8/1935 Walters ..... 123/169 EC
D200,774 S * 4/1965 Livingston ..... 123/169 R
3,650,249 A * 3/1972 Honda ..... 123/169 R
3,738,345 A * 6/1973 Gumtow ..... 123/169 R
4,373,478 A * 2/1983 Rifat ..... 123/169 R

FOREIGN PATENT DOCUMENTS

JP 7-30913 7/1995

* cited by examiner

*Primary Examiner*—Henry C. Yuen
*Assistant Examiner*—Jason Benton
(74) *Attorney, Agent, or Firm*—Michael D. Bednarek; Shaw Pittman LLP

(57) ABSTRACT

A spark plug guard can be switched between a spark-plug covering position to protect a spark plug and a spark-plug opening position. An operator displaces the spark plug guard from the spark-plug covering position to the spark-plug opening position, thereby obtaining a wide working space to perform the maintenance and inspection of the spark plug efficiently. The spark plug guard has a function of fixing a predetermined part in the spark-plug covering position. Consequently, the need for a part fixing member which was conventionally required for fixing the predetermined part to the engine body is eliminated, thus contributing to a decrease in the weight of the whole internal combustion engine and to cost reduction.

18 Claims, 3 Drawing Sheets

POWER WORKING MACHINE WITH INTERNAL COMBUSTION ENGINE HAVING SPARK PLUG

BACKGROUND OF THE INVENTION

1. Field of the Invention

The present invention relates to a power working machine equipped with an internal combustion engine having a spark plug. The present invention also concerns a spark plug guard for protecting the spark plug.

2. Description of the Related Art

Some portable working machines such as brush cutters and hedge trimmers are equipped with an internal combustion engine, such as a small air-cooled two-stroke cycle gasoline engine, as a prime mover for driving a cutting blade (a working member). The internal combustion engine has a spark plug at the head of a cylinder constituting the engine body. The terminal of the spark plug projecting outward from the cylinder head is covered with a detachable plug cap, to which an ignition high-tension lead is connected, for protection.

In order to protect the spark plug perfectly, it is preferable to provide a spark plug guard for covering above the plug cap. This is for the purpose of preventing damage to the spark plug by the contact of the plug cap with articles during transportation of the portable working machine by track or the like, during depositing in storage, or during replacement of the cutting blade with the internal combustion engine placed upside down on the ground.

However, if the spark plug guard is secured to the engine body with screws and so on, troublesome detachment work of the spark plug guard is required during maintenance of the spark plug, thus resulting in a decrease in workability.

Also, if a part designed specifically for protection of the spark plug is mounted to the engine body, the machine increases in weight correspondingly, thus going against the demand for compact and lightweight portable working machines and causing an increase in cost.

SUMMARY OF THE INVENTION

The present invention has been made in consideration of the foregoing problems. Accordingly, it is an object of the present invention to provide a power working machine and a spark plug guard capable of contributing to an increase in maintenance workability of a spark plug, weight reduction of the entire internal combustion engine, and cost reduction.

In order to attain the above object, a power working machine according to the present invention is equipped with an internal combustion engine having a spark plug, comprising a spark-plug guard capable of switching between a spark-plug covering position to cover the spark plug for protection and a spark-plug opening position to be apart from the spark plug to facilitate access to the spark plug, the spark plug guard having a part fixing function of fixing a predetermined part to a body of the internal combustion engine in the spark-plug covering position.

According to the present invention, during the maintenance of the spark plug, an operator displaces the spark plug guard from the spark-plug covering position to the spark-plug opening position. Therefore, the covered state of the spark plug by the spark plug guard is easily released to provide a wide working space, thus facilitating maintenance and inspection of the spark plug.

The spark plug guard also includes a function of fixing the predetermined part in addition to a function of protecting the spark plug. Therefore, fitting means, which were necessary for securing the predetermined part to the engine body, become unnecessary, so that the entire internal combustion engine can be reduced in weight and cost.

The spark plug guard may be arranged on either side of the engine body and the predetermined part.

The way of displacement of the spark plug guard may be of slide type, rotation type, pivot type, draw type and so on.

As a preferable embodiment, the spark plug guard may comprise an attachment section to either one of the engine body and the predetermined part; and an engagement section engageable with the other one of the engine body and the predetermined part. In this case, when the spark plug guard is attached to either one of the engine body and the predetermined part and the engagement section is attached to the other one of the engine body and the predetermined part, the spark plug guard is brought into the spark-plug covering position, thereby fixing the predetermined part to the engine body.

As a preferable embodiment, the predetermined part may be fixed to the engine body via a toggle mechanism. With such an arrangement, the predetermined part can easily be fixed by the spark plug guard, and also the fixed state is stable; thus, it is preferable.

As a preferable embodiment, the predetermined part may be a cleaner cover for covering an air cleaner of the internal combustion engine. With such an arrangement, since relatively frequent opening and closing operation of the cleaner cover can quickly be performed with less effort, the maintenance and inspection of the air cleaner can also be performed efficiently.

As a preferable embodiment, the spark plug guard may further comprise a finger hole for an operator to engage the finger therewith in displacement from the spark-plug covering position to the spark-plug opening position. With such an arrangement, the operator (worker) can easily switch the position of the spark plug guard, and the spark plug guard itself is reduced in weight; thus, it is more preferable.

As a preferable embodiment, the finger hole may face a plug cap put on the spark plug in the spark-plug covering position. In this case, the finger hole serves as an air-circulating channel toward the plug cap, providing a cooling effect of the spark plug; thus, it is more preferable.

As a preferable embodiment, the finger hole may be arranged in the position for a tool inserted therethrough to be able to reach a control section of a carburetor of the internal combustion engine. With such an arrangement, the spark plug guard does not obstruct the operation of controlling the flow rate of the fuel in the carburetor; thus, it is preferable.

As a preferable embodiment, the internal combustion engine may comprise an engine cover including a first cover and a second cover joined with each other, the first cover including the spark plug guard, the spark plug guard including an engagement section to the second cover for bringing the engagement section into engagement with the second cover, and the spark plug guard being displaced to the spark-plug covering position, so that the first cover and the second cover being joined with each other.

DESCRIPTION OF THE PREFERRED EMBODIMENTS

Figure 1:
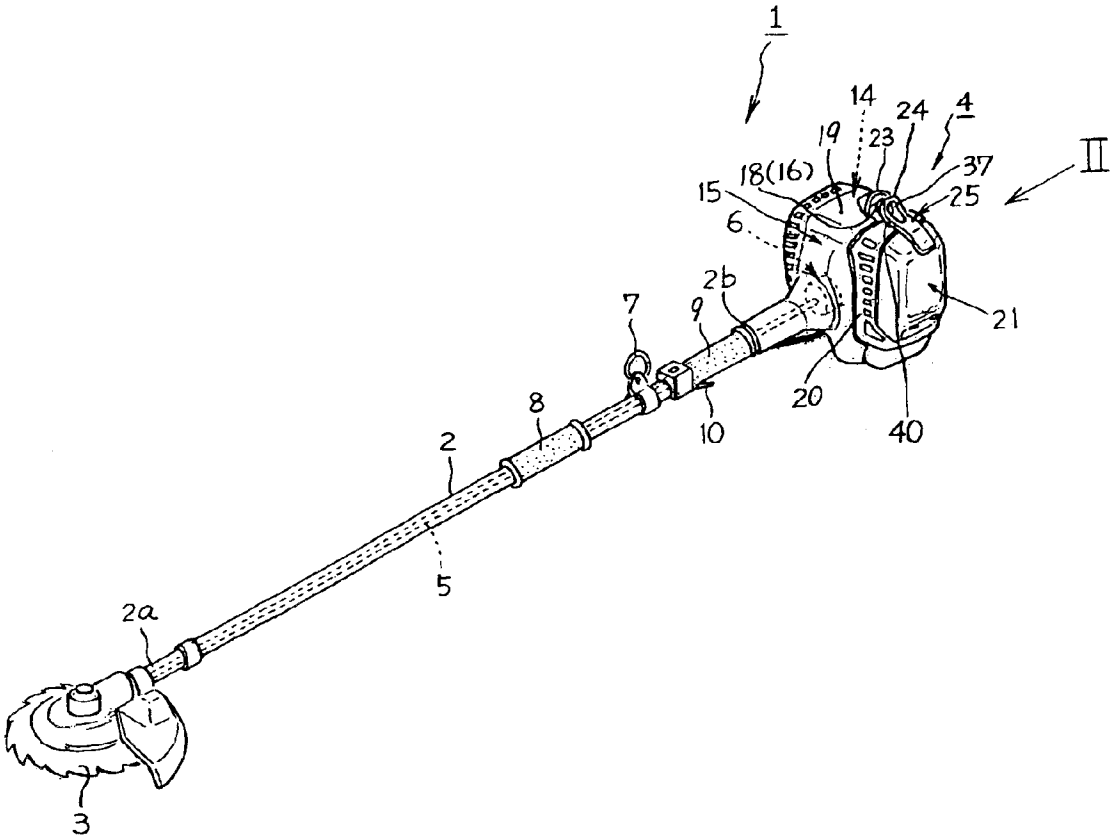
FIG. 1 is a general perspective view of a brush cutter as an example of a power working machine according to an embodiment of the present invention.

Referring to FIG. 1, a portable brush cutter 1 as a working machine according to an embodiment of the present invention includes a rotary cutting blade 3 as a power working member at the front end 2*a* of an operating rod 2 extending longitudinally, and includes an internal combustion engine such as a small air-cooled two-stroke cycle gasoline engine 4 at the rear and 2*b* of the operating rod 2. The driving force by the internal combustion engine 4 is transmitted to the cutting blade 3 via a transmission shaft 5 extending through the operating rod 2. An appropriate type of centrifugal clutch 6 is interposed between the internal combustion engine 4 and the transmission shaft 5. When the rotation speed of the internal combustion engine 4 exceeds a certain value, the rotation driving force is outputted to the cutting blade 3.

The operating rod 2 has a hanging ring 7 near the rear end 2*b*. An operator can hold the brush cutter 1 on his/her shoulder in a balanced manner by hanging a shoulder belt (not shown) on the hanging ring 7.

The operator holds front and rear grips 8 and 9 made of rubber or the like and attached on the operating rod 2 with hands, and cuts the grass while operating a throttle lever 10 arranged at the front of the rear grip 9 and swinging the front end 2*a* of the operating rod 2 from side to side.

Figure 2:
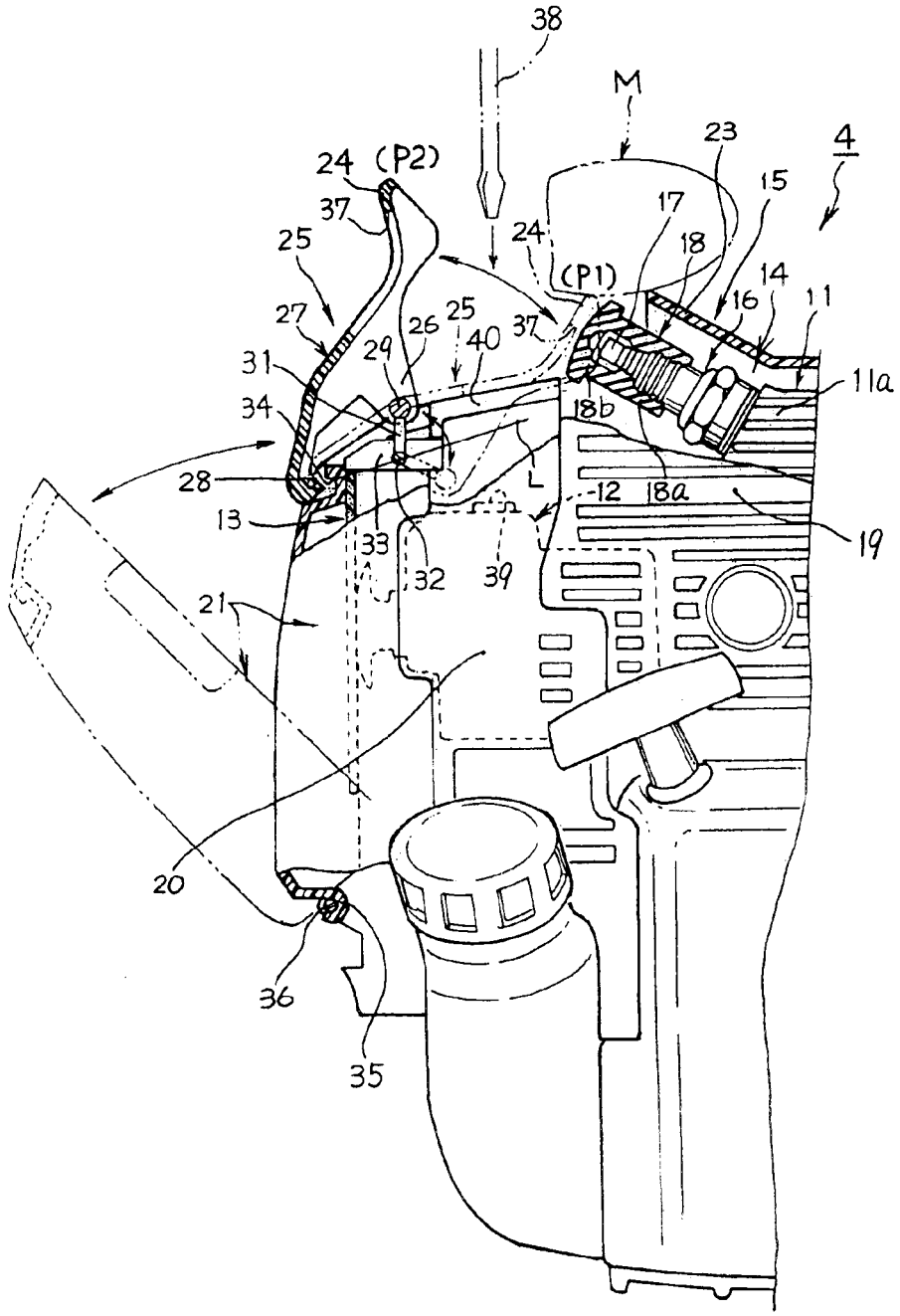
FIG. 2 is a partly cutaway enlarged view seen from the direction of arrow II of FIG. 1, showing essential parts of an internal combustion engine.

Referring to FIG. 2, the internal combustion engine 4 is equipped with an engine body 14 including a cylinder 11, a carburetor 12, an air cleaner 13, a crank casing (not shown); and an engine cover 15 for covering the periphery of the engine body 14. The cylinder 11 has a spark plug 16 attached to a head 11*a* thereof. An end 17 near the terminal of the spark plug 16 extends outwardly and diagonally upward from the cylinder 11, to which a plug cap 18 made of rubber or the like and connecting to an ignition high-tension lead (not shown) is fitted.

Air that was purified with the air cleaner 13 is mixed with lubricant-containing fuel atomized by the carburetor 12 and is supplied to the cylinder 11 regularly by reciprocating slide motion of a piston (not shown) placed in the cylinder 11.

The engine cover 15 is formed of a combination of covers integrally molded of a synthetic resin material having appropriate heat resistance and strength. For example, the engine cover 15 has a body cover 19 for covering the cylinder 11 and the periphery as a main body, a carburetor cover 20 for mainly covering the carburetor 12, and a cleaner cover 21 for covering the air cleaner 13 held by the carburetor cover 20. In this embodiment, the carburetor cover 20 is joined to the body cover 19 that is a first cover which is attached directly to the engine body 14; and the cleaner cover 21 that is a second cover is joined to the carburetor cover 20.

The body cover 19 includes a fixed guard 23 for covering an opening-side half 18*a* of the plug cap 18. The fixed guard 23 covers above the plug cap 18 together with a spark plug guard 25 having a moving guard 24 to protect the spark plug 16 in cooperation with the spark plug guard 25.

The spark plug guard 25 has a protecting function for the spark plug 16 and a part fixing function of fixing a predetermined part of the internal combustion engine 4, such as the cleaner cover 21, to the engine body 14. The spark plug guard 25 can be switched between a spark-plug covering position P1 to cover the spark plug 16 for protection and a spark-plug opening position P2 to be apart from the spark plug 16 to facilitate access to the spark plug 16. The cleaner cover 21 is fixed to the engine body 14 in the spark-plug covering position P1.

In other words, the spark plug guard 25 serves as a spark-plug protecting member and also as a part-fixing member. Therefore, the spark plug guard 25 serving as a part fixing member can freely be switched between the spark-plug covering position P1 to fix the cleaner cover 21 to the engine body 14 and the spark-plug opening position P2 to cancel the fixed state of the cleaner cover 21 to the engine body 14. The moving guard 24 of the spark plug guard 25 covers the spark plug 16 in the spark-plug covering position P1 for protection, and is separated from the spark plug 16 to secure a wide working space, thus facilitating access to the spark plug 16.

In this embodiment, the spark plug guard 25 is pivotally attached to and supported by the carburetor cover 20 constituting the first cover together with the body cover 19.

Figure 3:
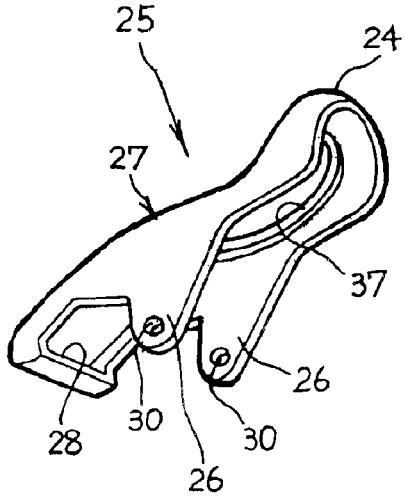
FIG. 3 is a general perspective view of a spark plug guard in FIG. 2.

More specifically, referring to FIGS. 2 and 3, the spark plug guard 25 is molded in one piece of an appropriate synthetic resin material having low heat conductivity, and includes a main body 27 having a pair of bearing brackets 26, 26 facing each other at the lengthwise center thereof, the moving guard 24 formed at one end of the main body 27, and an engagement claw 28 formed at the other end of the main body 27 and engageable with the cleaner cover 21. Each of the pair of bearing brackets 26, 26 has a bearing hole 30 for relatively rotatably receiving a horizontal first pivot shaft 29.

As shown in FIG. 2, the first pivot shaft 29 is integrally joined to a second pivot shaft 32 extending in parallel with the first pivot shaft 29 via a joining piece 31. The second pivot shaft 32 is fitted in a bearing 33 of the carburetor cover 20 and is supported relatively rotatably. The first pivot shaft 29 can pivot within a predetermined angle while maintaining a certain relative distance from the second pivot shaft 32. Therefore, the spark plug guard 25, which is relatively rotatably supported on the first pivot shaft 29 in the pair of bearing brackets 26, 26 serving as attachment sections, can pivot around the first pivot shaft 29 and also around the second pivot shaft 32.

The spark plug guard 25 can be formed by an appropriate material such as the synthetic resin having sufficient rigidity to protect the spark plug 16 and elasticity required to work as a toggle latch, which will be described later.

On the other hand, the cleaner cover 21 that is a second cover includes, at the upper part, an engagement receiving section 34 engageable with the engagement claw 28 of the spark plug guard 25. The cleaner cover 21 has a hook-shaped engagement section 35 at the lower end, which is in engagement with a cleaner-cover pivot shaft 36 formed at the lower end of the carburetor cover 20; thus, the upper end can pivot around the cleaner-cover pivot shaft 36.

In order to bring the cleaner cover 21 in intimate contact with the carburetor cover 20 of the engine body 14, the spark plug guard 25 is appropriately rotated around the first pivot shaft 29 and the second pivot shaft 32 with the cleaner cover 21 closed, and the engagement claw 28 is brought into engagement with the engagement receiving section 34 of the cleaner cover 21. Then, while maintaining the engaging state, the moving guard 24 of the spark plug guard 25 is rotated downwardly. Thus, the spark plug guard 25 pivots around the first pivot shaft 29 and the second pivot shaft 32 clockwise in FIG. 2 to move the first pivot shaft 29 over line L (dead center) that connects the second pivot shaft 32 and the engagement receiving section 34 of the cleaner cover 21, where the direction of the reactive force is reversed, thereby being self-locked in the spark-plug covering position P1 shown by an imaginary line in FIG. 2 (a toggle mechanism). The spark plug guard 25 connects the cleaner cover 21 to the carburetor cover 20 in the spark-plug covering position PI. More specifically, the spark plug guard 25 fixes the cleaner cover 21 as a toggle latch to the carburetor cover 20 while sandwiching the air cleaner 13 therebetween.

When the spark plug guard 25 is in the spark-plug covering position P1, the moving guard 24 is positioned above a closing-side half 18*b* of the plug cap 18. More specifically, the moving guard 24 covers above the plug cap 18 together with the fixed guard 23 formed at the upper part of the body cover 19 to protect the spark plug 16 in cooperation with the fixed guard 23. Accordingly, direct collision of an article M such as a floor and other equipment with the plug cap 18 can be prevented during cutting work or transportation and housing of the brush cutter 1; thus, damage to the spark plug 16 can be prevented and the operator can be protected from heat and high voltage supplied to the spark plug 16 during the operation of the internal combustion engine 4.

During the maintenance of the spark plug 16, the operator switches the spark plug guard 25 from the spark-plug covering position P1 to the spark-plug opening position P2. Thus, the moving guard 24 is widely separated from the spark plug 16 to release the covered state of the spark plug 16 with the spark plug guard 25 easily, thus facilitating maintenance and inspection of the spark plug 16, such as detaching the plug cap 18, using a wide working space thus obtained.

The spark plug guard 25 also has a function of joining the cleaner cover 21 to the carburetor cover 20 in addition to a function of protecting the spark plug 16. Therefore, exclusive parts such as screws for securing the cleaner cover 21 to the engine body 14 are not necessary, so that the entire internal combustion engine 4 can be reduced in weight and cost.

Furthermore, according to this embodiment, since it is easy to change the position of the spark plug guard 25 serving as a fixing bracket, the cleaner cover 21 can quickly be opened and closed with less effort as compared with a case by the conventional fixing method using screws and so on. Accordingly, the maintenance and inspection of the air cleaner 13 can also be performed efficiently.

Also, since the cleaner cover 21 is fixed to the carburetor cover 20 via the spark plug guard 25 and the toggle mechanism, the fixed state is stable; thus, it is more preferable.

In this embodiment, as shown in FIG. 2, a spark-plug-guard receiving opening 40 is opened in the form of notch at the upper part of the carburetor cover 20. The spark plug guard 25 displaces to the spark-plug covering position P1, so that most outline of the spark plug guard 25 comes in the plug-guard receiving opening 40. Accordingly, as shown in FIGS. 1 and 2, the outline of the whole internal combustion engine 4 becomes compact, thus facilitating working while carrying it.

Referring to FIGS. 2 and 3, the spark plug guard 25 has a finger hole 37 suitable for use in pivotal displacement. The finger hole 37 facilitates the pivotal displacement from the spark-plug covering position P1 in a self-locking state to the spark-plug opening position P2. Also, since the spark plug guard 25 itself is decreased in weight by the amount corresponding to the notch of the finger hole 37, it is more preferable.

Referring to FIG. 2, in this embodiment, the finger hole 37 is formed in the position to face the plug cap 18 in the spark-plug covering position P1. Therefore, the finger hole 37 serves as an air-circulating channel toward the plug cap 18, thus providing a cooling effect of the spark plug 16.

Moreover, in this embodiment, the finger hole 37 is arranged in the position for a tool such as a screwdriver 38 inserted therethrough to be able to reach a control section 39 of the carburetor 12. Accordingly, even when the spark plug guard 25 is closed in the spark-plug covering position P1, it does not obstruct the operation of controlling the flow rate of the fuel in the carburetor 12, thus being preferable.

The spark plug guard 25 is not limited to the foregoing arrangement, but may be of other known toggle-latch types.

The spark plug guard 25 is not limited to the toggle-latch type, but may be one equipped with a moving guard having an attachment section to the carburetor cover 20, an elastic member such as a spring and rubber connected to the moving guard, and an engagement section attached to the elastic member and engageable with the cleaner-cover 21. In this case, when the spark plug guard is arranged between the carburetor cover 20 and the cleaner cover 21 against the elasticity of the elastic member, the cleaner cover 21 is fixed to the carburetor cover 20 by the elasticity of the elastic member, and the moving guard covers above the spark plug 16 for protection.

Furthermore, contrary to the above described embodiment, the toggle-latch type of spark plug guard may be mounted to the cleaner cover 21. In this arrangement, the spark plug guard has an engagement section which can engage with an engagement receiving section formed on the carburetor cover 20, wherein the engagement section is brought into engagement with the engagement receiving section, so that the cleaner cover 21 is fixed to the carburetor cover 20.

What is claimed is:

1. A power working machine equipped with an internal combustion engine having a spark plug, comprising a spark plug guard capable of switching between a spark-plug covering position to cover the spark plug for protection and a spark-plug opening position to be apart from the spark plug to facilitate access to the spark plug, the spark plug guard also fixing a part other than the spark plug to the internal combustion engine when in the spark-plug covering position.

wherein the internal combustion engine comprises an engine cover including a first cover and a second cover joined with each other, the first cover including the spark plug guard, the spark plug guard including an engagement section to the second cover for bringing the engagement section into engagement with the second cover, and the spark plus guard being displaced to the spark-plug covering position, so that the first cover and the second cover are joined with each other.

2. The power working machine according to claim 1, wherein the spark plug guard comprises an attachment section to the engine.

3. The power working machine according to claim 1, wherein the part is fixed to the engine via a toggle mechanism of the spark plug guard.

4. A power working machine equipped with an internal combustion engine having a spark plug, guard comprising a spark plug guard capable of switching between a spark-plug covering position to cover the spark plug for protection and a spark-plug opening position to be apart from the spark plug to facilitate access to the spark plug, the spark plug guard also fixing a part other than the spark plug to the internal combustion engine when in the spark-plug covering position, wherein the part is a cleaner cover for covering an air cleaner of the internal combustion engine.

5. The power working machine according to claim 1, wherein the spark plug guard further comprises a finger hole for an operator to engage the finger therewith in displacement from the spark-plug covering position to the spark-plug opening position.

6. The power working machine according to claim 5, wherein the finger hole faces a plug cap put on the spark plug in the spark-plug covering position.

7. The power working machine according to claim 5, wherein the finger hole is arranged in the position for a tool inserted therethrough to be able to reach a control section of a carburetor of the internal combustion engine.

8. The power working machine according to claim 1, wherein the first cover and the second cover are joined with each other by a toggle mechanism of the spark plug guard.

9. The power working machine according to claim 1, wherein either of the first cover and the second cover is a cleaner cover for covering an air cleaner of the internal combustion engine.

10. The power working machine according to claim 1, wherein either of the first cover and the second cover comprises a fixed guard for protecting the spark plug in cooperation with the spark plug guard in the spark-plug covering position.

11. The power working machine according to claim 1, wherein at least either of the first cover and the second cover comprises a spark-plug-guard receiving opening for receiving the spark plug guard in the spark-plug covering position.

12. The power working machine according to claim 1, wherein the spark plug guard comprises a finger hole for an operator to engage the finger therewith in displacement from the spark-plug covering position to the spark-plug opening position.

13. A spark plug guard capable of switching between a spark-plug covering position to cover a spark plug of an internal combustion engine for protection and a spark-plug opening position to be apart from the spark plug to facilitate access to the spark plug, the spark plug guard also fixing a part other than the spark plug to the internal combustion engine when in the spark-plug covering position, wherein the part is a cleaner cover for covering an air cleaner of the internal combustion engine.

14. The spark plug guard according to claim 13, comprising an attachment section to either one of the engine and the part; and an engagement section engageable with the other one of the engine and the part.

15. The spark plug guard according to claim 13, wherein the part is fixed to the engine via a toggle mechanism.

16. The spark plug guard according to claim 13, further comprising a finger hole for an operator to engage the finger therewith in displacement from the spark-plug covering position to the spark-plug opening position.

17. The spark plug guard according to claim 16, wherein the finger hole faces a plug cap put on the spark plug in the spark-plug covering position.

18. A spark plug guard capable of switching between a spark-plug covering position to cover a spark plug of an internal combustion engine for protection and a spark-plug opening position to be apart from the spark plug to facilitate access to the spark plug, the spark plug guard also fixing a part other than the spark plug to the internal combustion engine when in the spark-plug covering position, the spark plug guard further comprising a finger hole for an operator to engage a finger therewith in displacement from the spark-plug covering position to the spark-plug opening position, wherein the finger hole is arranged in the position for a tool inserted therethrough to be able to reach a control section of a carburetor of the internal combustion engine.

* * * * *